US007182013B1

(12) United States Patent
Hardo

(10) Patent No.: US 7,182,013 B1
(45) Date of Patent: Feb. 27, 2007

(54) UMBILICAL RETRACTION ASSEMBLY AND METHOD

(75) Inventor: Peter J. Hardo, Seekonk, MA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 402 days.

(21) Appl. No.: 10/794,541

(22) Filed: Mar. 1, 2004

(51) Int. Cl.
*F41F 3/04* (2006.01)

(52) U.S. Cl. ..... 89/1.811; 89/1.81; 114/238

(58) Field of Classification Search ..... 89/1.811, 89/1.81; 114/238
See application file for complete search history.

(56) References Cited

U.S. PATENT DOCUMENTS 1,418,851 A * 6/1922 Trenor ..... 114/24
3,224,335 A * 12/1965 Witherspoon et al. ..... 89/1.811
3,245,319 A * 4/1966 Kossan et al. ..... 89/1.811
3,444,779 A * 5/1969 Buell et al. ..... 89/1.811
3,593,613 A * 7/1971 Davis ..... 89/1.811
4,092,898 A * 6/1978 Witherspoon ..... 89/1.811
6,418,870 B1 * 7/2002 Lanowy et al. ..... 114/238

* cited by examiner

*Primary Examiner*—M. Clement
(74) *Attorney, Agent, or Firm*—James M. Kasischke; Jean-Paul A. Nasser; Michael P. Stanley

(57) ABSTRACT

An umbilical cord retractor assembly and method is provided for retracting an umbilical cord from a torpedo or other vehicle prior to launching the vehicle. A guide arm is utilized to guide a slide member along a predetermined path within the guide arm. The slide is connected through a link to the umbilical cord such that the umbilical cord is pulled to a predetermined position within the launch tube out of the way of the fins, shroud, and propeller of the vehicle. Prior to activation of the retractor assembly, the slide is affixed in position within the guide arm by a lock. A spring under tension applies a force to the slide. A release cord pulls a pin from the slide to release the cord at a desired time, thereby retracting the umbilical cord to the predetermined position within the launch tube.

10 Claims, 2 Drawing Sheets

UMBILICAL RETRACTION ASSEMBLY AND METHOD

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to remote retraction of umbilical cables which may be utilized in torpedo systems and, more particularly, to assemblies and methods for actively and remotely removing an umbilical cable from a torpedo, prior to launching the weapon from the launch tube.

(2) Description of the Prior Art

Electrical umbilical cables are utilized to provide communications, power, and other functions to a torpedo in a launch tube. The electrical umbilical cable must be detached prior to launch of a torpedo. The United States Navy has previously launched torpedoes from surface ships via high-pressure air. However, it has been found desirable to provide an advanced surface launcher that eliminates the high-pressure air and instead utilizes readily available and highly reliable automotive air bag inflators as the energy source for launching torpedoes. In high-pressure air launching systems, a portion of the high-pressure air energy was used to mechanically detach the electrical umbilical from the weapon just prior to launch. With the elimination of the high-pressure air from the system, the prior art methods of umbilical cord retraction are no longer functional.

Previous efforts to solve problems related to the above are described by the following patents:

U.S. Pat. No. 4,555,130, issued Nov. 26, 1985, to D. W. McClain, discloses a quick-disconnect device for coupling segments of a diver's umbilical hoses includes separable rectangular bodies carrying complementary hose couplings spaced therealong. The bodies, which have nested rim and reduced portions, are biased toward separation by a rectangular, flat-type spring and releasable retained against separation by a retractable retaining pin extending diagonally therethrough and normally locked against retraction by partial rotation.

U.S. Pat. No. 4,086,776, issued Apr. 11, 1977, to R. M. Beard, discloses a lock means for one end of a tension line for securing the tension line to a subsea installation and particularly for securing one end of an umbilical line carrying hydraulic and electrical control circuits to a subsea installation. The lock means is co-operable with a guide and locking cylindrical member secured to the subsea installation, the cylindrical member having a lock dog receiving recess, and a cylindrical locking device receivable within the cylindrical member and secured to the end of the tension line. The locking device includes a cylindrical housing having a lock dog port and a cylindrical chamber, an elongated annular or sleeve-like piston member within the housing and longitudinally slidable relative to the tension line. The piston member includes a cam surface to slidably engage lock dogs for lateral movement thereof through the lock dog port into locking engagement with the lock recess, a piston portion co-operable with a cylindrical chamber for unlocking the device under fluid pressure, and a piston extension having an upper end exposed through a window for mechanically unlocking the locking device. The piston member is normally biased into locked position by spring means, the locking device being normally non-releasing.

U.S. Pat. No. 4,258,504, issued Mar. 31, 1981, to H. H. Hicks, discloses a cable release and latch for a security guard hinged to a window with a spring loaded plunger wedged into an outer frame thereof. An armored cable with a flexible inner cable is connected to the spring loaded plunger and extends to a foot treadle operator and shield which may be mounted on the floor inside the opening. Sufficient length of cable is provided to allow free movement of the guard about its hinges. The security guard may thereby be quickly and easily opened without a key by stepping on the foot treadle operator. If the armored cable is severed, the spring loaded plunger advances further into the keeper which retracts the flexible cable within the armored housing to prevent the manual operation of the latch without further dismantling of the cable.

U.S. Pat. No. 4,300,254, issued Nov. 17, 1981, to M. J. Prior, discloses a release mechanism for use with an underwater exploration device such as one used to release ballast from an ocean bottom seismograph which includes primary and secondary release actuating devices. Ballast weights are secured to the seismograph by cables which themselves are secured by levers held immobile by a removable pin. The pin can be removed by the primary release actuating device, a rotary solenoid with linkage arms which produces a linear stroke, or by the secondary release actuating device, a coil spring held in compression by means of an electroplatable wire around and under the head of the pin, or both, allowing the levers to pivot releasing the cables and ballast weight. The mechanical advantage of the levers is utilized to allow a relatively heavy ballast weight to be held while requiring a much smaller force to remove the pin allowing its release.

The above described systems do not provide an umbilical release mechanism suitable for use in retracting the cable prior to launching a torpedo including means for avoiding any possibility of entanglement with the fins and propellers. Consequently, those skilled in the art will appreciate the present invention that addresses the above and other problems.

SUMMARY OF THE INVENTION

An object of the present invention is to provide a means to actively and remotely remove an umbilical cable from a vehicle, prior to launching the vehicle from a launch tube.

Another object of the present invention is to position the removed umbilical cord within the launch tube such that the fins, shroud, and propeller of the launched vehicle do not become entangled with the umbilical cable.

These and other objects, features, and advantages of the present invention will become apparent from the drawings, the descriptions given herein, and the appended claims. However, it will be understood that above listed objects and advantages of the invention are intended only as an aid in understanding various aspects of embodiments of the invention, are not intended to limit the invention in any way, and do not form a comprehensive list of objects, features, and advantages.

The present invention provides an umbilical cord retractor for use in retracting the umbilical cord from a vehicle within a launch tube prior to launch. The umbilical cord retractor comprises one or more elements such as, for instance, a guide arm mountable within the launch tube adjacent the vehicle, a slide mounted within the guide arm and slidable along a predetermined path formed by the guide arm, a biasing member attached to the slide for creating a biasing force to pull the slide away from the vehicle, and/or a locking member to hold the slide in position against a biasing force until the locking member is released. Other elements may comprise a linking member attached between the slide and the umbilical cord and/or an activator for releasing the locking member from the slide whereby the slide is pulled by the biasing member and the attached linking member then pulls the umbilical cord to a predetermined position with respect to the guide arm. The slide, linking member, biasing member, and/or other components, could be fabricated in one-piece construction for faster assembly, if desired.

The activator may comprise a solenoid in one embodiment. Likewise, in one embodiment, the locking member may comprise a pin insertable into a matching notch, hole, or groove in the slide. The pin may be angularly oriented with respect to the slide.

The biasing member may comprise any type of spring including metal, elastic, or other types of springs.

In operation, a method for retracting an umbilical cord from a vehicle within a launch tube prior to launching the vehicle may comprise one or more steps such as, for instance, attaching a slidable member to the umbilical cord by means of a linking member, biasing the slidable member, locking the slidable member in position within a guide arm, and/or releasing the slidable member to slide within the guide arm along a predetermined path whereby the linking member retracts the umbilical cord and pulls it to a predetermined position with respect to the guide arm.

In one embodiment, the step of locking may further comprise inserting a locking pin into the slidable member. The step of releasing may further comprise electrically activating a solenoid. The method may further comprise connecting the solenoid to a push-pull cable and connecting the locking pin to the push-pull cable.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawing, wherein like reference numerals refer to like parts and wherein.

DESCRIPTION OF THE PREFERRED EMBODIMENT

Figure 1:
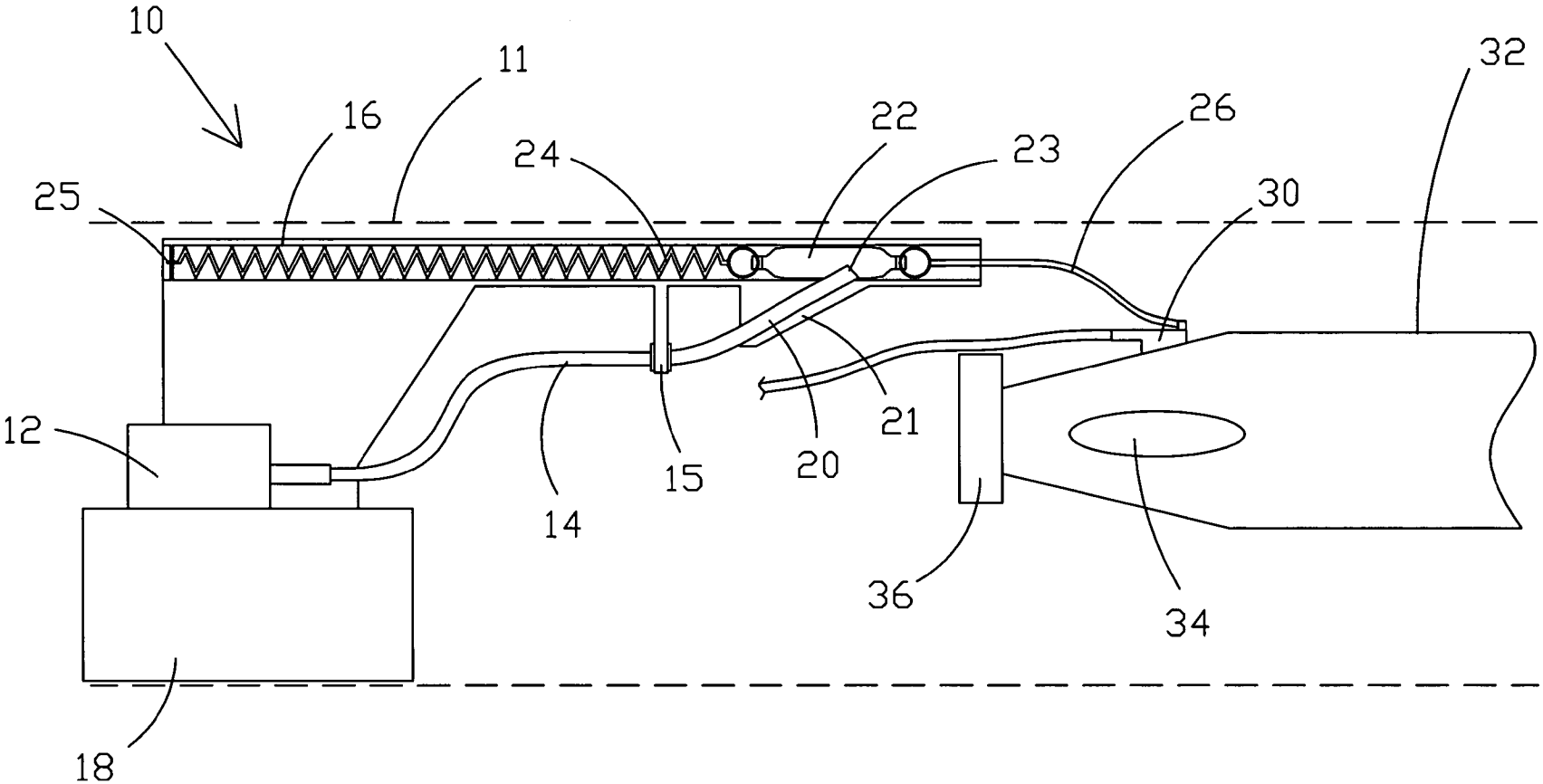
FIG. 1 is an elevational view showing a retraction assembly connected to a torpedo umbilical cord armed and connected to a torpedo in accord with the present invention.

Referring now to the drawings and, more particularly, to FIG. 1 there is shown mechanical umbilical retraction assembly 10 attached to an umbilical cable and vehicle in the armed state. The present invention provides a novel mechanical umbilical retraction mechanism 10 which fits within predefined launch tube envelope 11, is actuated remotely, and actively removes the umbilical 30 from vehicle 32, and positions umbilical 30 to the side of the launch tube 11 out of the way of fins 34 and shroud 36 of exiting vehicle 32.

In the armed state shown in FIG. 1, solenoid 12 is in an extended, de-energized state. Solenoid 12 is connected to push-pull cable 14 that is routed to an attachment point on the extension or guide arm 16 by suitable means as discussed hereinafter. The extension or guide arm 16 and solenoid 12 are fastened to a fixed surface 18 located in launch tube 11. In one presently preferred embodiment, the opposite end of the push-pull cable 14 extends though guide 15 for connection with extension arm 16 through securing pin 20. Securing pin 20 is routed through laterally protruding flange 21 which extends outwardly from extension arm 16 and is preferably angularly inserted into a groove 23 formed in a slide 22. Securing pin 20 is preferably affixed in laterally protruding flange 21 by push-pull cable 14 and extends into slide 22 to thereby prevent slide 22 from moving axially within arm 16 in either direction. Push-pull cable 14 could comprise a suitable mechanical linkage of any type. Slide 22 incorporates features to which a spring 24 and lanyard 26 can be attached. Slide 22 is preferably located inside preferably cylindrical extension arm 16, which may be tubular and/or have lateral guide walls, such that slide 22 can move along a predetermined pathway which is preferably axial but could be shaped as desired. Spring 24 is secured at one end to end 25 of the extension arm 16 and on the other end to slide 22. In the armed state, spring 24 is preferably fully extended or extended sufficiently to provide a suitably strong retracting force for pulling on the slide 22 to retract umbilical cable 30, as discussed subsequently. The opposite side of the slide 22 is connected to a lanyard 26, which in turn is connected to the umbilical cable 30. The umbilical cable 30 is attached to the torpedo 32.

Figure 2:
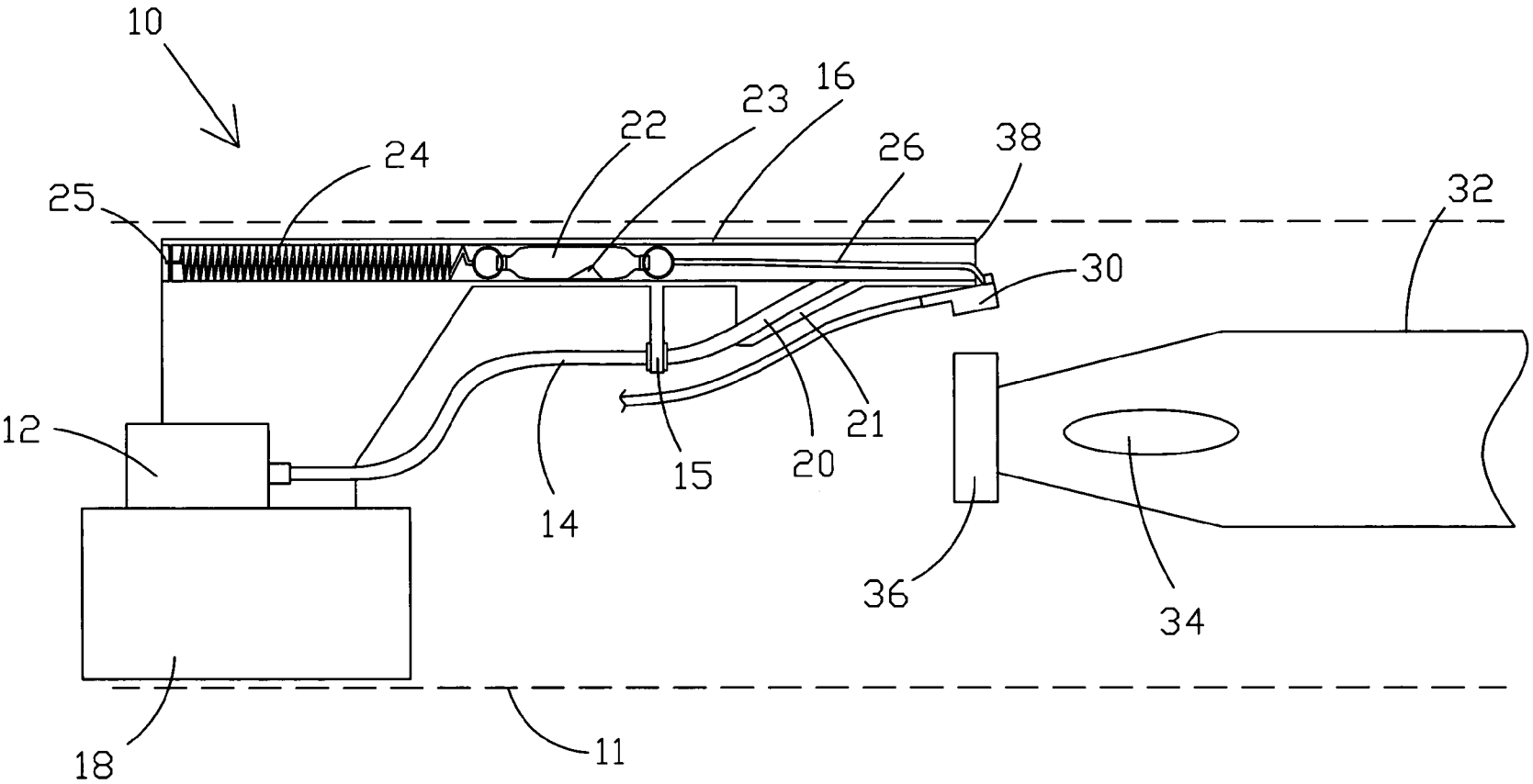
FIG. 2 is an elevational view showing the torpedo umbilical cord retracted prior to launching the torpedo utilizing the retraction assembly in accord with the present invention.

FIG. 2 depicts how the mechanical umbilical retraction assembly 10 remotely and actively removes umbilical cable 30 prior to torpedo launch. The solenoid 12 is energized thus pulling push-pull cable 14 that in turn pulls securing pin 20 out of slide 22. Once securing pin 20 is removed, then slide 22 is forced down the extension arm 16 in an axial direction away from torpedo 32 by the spring 24. As slide 22 moves axially away from torpedo 32, lanyard 26 is also pulled away from torpedo 32 thus removing umbilical cable 30 from the torpedo 32 and positioning umbilical cable 30 in a predefined position 38 at the end of guide arm 16.

It is noted that retraction assembly 10 pulls umbilical cable 30 away from shroud 36 and fins 34, which may be significantly larger than shown in FIG. 2, to thereby prevent any possibility of entanglement therewith. Moreover, shroud 36 could be located much closer to mount 18, so long as extension arm 16 were accordingly adjusted in length to reach to wherever umbilical cable 30 is located on torpedo 32. If necessary, extension or guide arm 16 could extend between vertical and horizontal fins and still remove umbilical cable 30 from the possibility of entanglement due to the ability to provide a predefined position 38 at which umbilical cable 30 will be located after retraction.

Accordingly, the present invention provides for the remote and active removal of umbilical cable 30 from torpedo 32 positioned within torpedo tube 11. Various alternative designs may be incorporated into the invention. For instance, slide 22 may be locked by other means and/or push-pull cable may be activated in other ways. For example, a ball type lock may be used to replace the securing pin 20. Likewise, solenoid could be positioned closer to slide and directly in contact with securing pin 20. Additionally, a linear actuator or rotary solenoid may be used to actuate the push-pull cable.

Therefore, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An umbilical cord retractor for use in retracting said umbilical cord from a vehicle, said umbilical cord retractor being mountable within a launch tube, said umbilical cord retractor comprising:

a guide arm mountable within the launch tube adjacent said vehicle;

a slide joinable to an umbilical cord, said slide being mounted within said guide arm and slidable along a predetermined path formed by said guide arm;

a biasing member attached to said slide for creating a biasing force to pull said slide in said predetermined path; and a pin insertable into said slide acting as a locking member to releasably hold said slide in position against a biasing force until said pin is released.

2. The umbilical cord retractor of claim 1, further comprising a linking member attached between said slide and said umbilical cord.

3. The umbilical cord retractor of claim 2, further comprising an activator joined to said pin for releasing said pin from said slide whereby said slide is pulled by said biasing member and said linking member pulls said umbilical cord to a predetermined position on said guide arm.

4. The umbilical cord retractor of claim 3, wherein said activator comprises a solenoid.

5. The umbilical cord retractor of claim 1, wherein said pin is angularly oriented with respect to said slide.

6. The umbilical cord retractor of claim 1, wherein said biasing member comprises a spring.

7. An umbilical cord retractor for use in retracting said umbilical cord from a vehicle, said umbilical cord retractor being mountable within a launch tube, said umbilical cord retractor comprising:

a guide arm mountable within the launch tube;

a slide within said guide arm and movable within said guide arm;

a locking member capable of releasably holding said slide in position within said guide arm;

a connection between said slide and the umbilical cord;

a tension member joined to apply a force to said slide;

a cord joined to said locking member such that a tensile force on said cord acts to release holding of said slide; and a solenoid joined to selectively apply the tensile force to said cord whereby said slide moves in response to said force from said tension member to pull the umbilical cord to a predetermined position relative to said guide arm.

8. The umbilical cord retractor of claim 7, wherein said locking member comprises a member insertable into said slide.

9. The umbilical cord retractor of claim 7, further comprising a mount for said guide arm secured within said launch tube.

10. The umbilical cord retractor of claim 9, wherein said guide arm is tubular and extends from said mount toward the vehicle.

* * * * *

UNITED STATES PATENT AND TRADEMARK OFFICE

CERTIFICATE OF CORRECTION

PATENT NO. : 7,182,013 B1
APPLICATION NO. : 10/794541
DATED : February 27, 2007
INVENTOR(S) : Peter J. Hardro It is certified that error appears in the above-identified patent and that said Letters Patent is hereby corrected as shown below:

Title page, item (75) Inventor, replace “Hardo” with --Hardro--.

Signed and Sealed this

First Day of May, 2007

JON W. DUDAS
*Director of the United States Patent and Trademark Office*